US011220821B2

(12) United States Patent
Poutanen

(10) Patent No.: US 11,220,821 B2
(45) Date of Patent: Jan. 11, 2022

(54) GLUED TIMBER TRUSSED JOIST, JOINT AND METHOD

(71) Applicant: Patenttitoimisto T. Poutanen Oy, Tampere (FI)

(72) Inventor: Tuomo Poutanen, Tampere (FI)

(73) Assignee: PATENTTITOIMISTO T. POUTANEN OY, Tampere (FI)

( * ) Notice: Subject to any disclaimer, the term of this patent is extended or adjusted under 35 U.S.C. 154(b) by 0 days.

(21) Appl. No.: 16/865,763

(22) Filed: May 4, 2020

(65) Prior Publication Data

US 2021/0340766 A1 Nov. 4, 2021

(51) Int. Cl.
*E04C 3/16* (2006.01)

(52) U.S. Cl.
CPC ..... *E04C 3/16* (2013.01)

(58) Field of Classification Search
CPC ..... E04C 3/16
See application file for complete search history.

(56) References Cited

U.S. PATENT DOCUMENTS

| | | | |
|---|---|---|---|
| 2,455,217 | A | 11/1948 | Alberto |
| 2,780,842 | A | 2/1957 | Hess |
| 3,075,524 | A | 1/1963 | Steidle-Sailer |
| 3,452,502 | A | 7/1969 | Price |
| 3,490,188 | A | 1/1970 | Troutner |
| 3,702,050 | A | 11/1972 | Price |
| 3,991,535 | A | 11/1976 | Keller |
| 4,074,498 | A | 2/1978 | Keller |
| 5,560,177 | A | 10/1996 | Brightwell |
| 5,664,393 | A | 9/1997 | Veilleux |
| 5,966,894 | A | 10/1999 | Crump, Jr. |
| 7,185,471 | B2 | 3/2007 | Schmerber |
| 7,975,736 | B2 | 7/2011 | Poutanen |
| 8,122,676 | B2 | 2/2012 | Lemyre |
| 8,424,577 | B2 | 4/2013 | Poutanen |
| 2002/0007611 | A1 | 1/2002 | Sanford |
| 2002/0040560 | A1 | 4/2002 | Kent |

(Continued)

FOREIGN PATENT DOCUMENTS

| | | |
|---|---|---|
| CA | 2008043 | 7/1991 |
| CA | 2335684 | 8/2002 |

(Continued)

OTHER PUBLICATIONS

German PERI website, "GT 24 Formwork Girder", Jul. 11, 2017, Retrieved from Internet: https://www.peri.com/en/products/formwork/gt-24-formwork-girder.html.

(Continued)

*Primary Examiner* — Patrick J Maestri
(74) *Attorney, Agent, or Firm* — Leason Ellis LLP

(57) ABSTRACT

A glued trussed joist, joint and method are provided which include two chords, the lower chord and the upper chord located a distance from each other and two elongated webs are located between the chords. The upper ends of the webs are connected in the upper chord and the lower ends of the webs connected in the lower chord. The lower ends of the webs have at least one tenon finger and the lower chord has a matching mortise routing. The tenon fingers are inserted using glue to make a joint to resist forces and moments in the joist and the chord routing goes through the chord.

17 Claims, 10 Drawing Sheets

(56) References Cited

U.S. PATENT DOCUMENTS

| | | | | |
|---|---|---|---|---|
| 2002/0148192 | A1 | 10/2002 | Veilleux | |
| 2002/0148193 | A1 | 10/2002 | Veilleux | |
| 2004/0074195 | A1 | 4/2004 | Schmerber | |
| 2005/0225172 | A1* | 10/2005 | Brightwell | E04C 3/16 305/107 |
| 2008/0092988 | A1 | 4/2008 | Poutanen | |
| 2008/0121312 | A1 | 5/2008 | Poutanen | |
| 2008/0250747 | A1 | 10/2008 | Johnson | |
| 2009/0094930 | A1 | 4/2009 | Schwoerer | |
| 2010/0061829 | A1 | 3/2010 | Mcadoo et al. | |
| 2010/0263319 | A1 | 10/2010 | Lemyre | |
| 2015/0267407 | A1 | 9/2015 | Sirowatka | |
| 2017/0016229 | A1 | 1/2017 | Cossette | |
| 2017/0058525 | A1 | 3/2017 | Hercus | |
| 2017/0234011 | A1* | 8/2017 | Poutanen | E04C 3/16 52/693 |

FOREIGN PATENT DOCUMENTS

| | | |
|---|---|---|
| CA | 2654720 | 5/2009 |
| CH | 306573 | 4/1955 |
| CH | 517876 | 1/1972 |
| CH | 542969 | 11/1973 |
| CH | 544199 | 11/1973 |
| CH | 550908 | 6/1974 |
| CH | 640591 | 1/1984 |
| DE | 2242329 | 3/1974 |
| FI | 118153 | 7/2007 |
| FR | 2058315 | 5/1971 |
| FR | 2185735 | 1/1974 |
| FR | 2718175 | 10/1995 |
| GB | 2038393 | 7/1980 |
| JP | 2014-55406 | 3/2014 |
| WO | WO 2009156559 | 12/2009 |
| WO | WO 2010/066783 | 6/2010 |
| WO | WO 2010/118531 | 10/2010 |
| WO | WO 2014053905 | 4/2014 |
| WO | WO 2016024040 | 2/2016 |

OTHER PUBLICATIONS

Coastal Forest Products, "Open Joist by TriForce®", Barret-company website http://coastalforestproducts.com/engineered-wood-products/open-joist/ Dec. 16, 2016.

Openjoist website, http://www.openjoist.com/ May 24, 2017.

Pasanen, Simo, Vierisalo, Joni. Liimaristikon valmistaminen ja koestaminen.

Lahden Ammattikorkeakoulu, Spring 2017. entire document, especially pp. 45-49; figure 1 on p. 3, figure 11 on p. 44, figure 13 on p. 46.

"Einsatzmoglichkeiten der DSB-Trager", Mar. 15, 1993.

* cited by examiner

GLUED TIMBER TRUSSED JOIST, JOINT AND METHOD

TECHNICAL FIELD

The present invention is generally directed to a glued trussed joist which is used primarily in horizontal load bearing joists in buildings, i.e., in floor and roofs, and more particularly, is directed to a glued trussed joist that includes, in at least one embodiment, a chord routing that passes completely though the chord to provide open routings without water pockets and increased sized glue areas without a glue line failure in the web finger nor splitting failure in the chord.

BACKGROUND

Timber trusses and joists are used routinely in buildings. Existing joists tend to be I-joists, solid timber joists, metal web trussed joists or timber trussed joists with connector plates. I-joist dominates the market, but it has disadvantages, such as, difficulties in crosswise opening, upper chord support and cross bracing. The current trussed joists include metal, have high material cost, are not trimmable nor cuttable. Solid timber joists are seldom used due to high material cost and several disadvantages.

Glued trusses and joists have potential. However, conventional glued trusses and joists suffer from a number of drawbacks, including but not limited to: web-chord glue areas are small with the joint force resistance small, the chord routing is slow and complicated, the quality checking difficult, there is no joist with an effective upper chord support, the existing routings include water pockets (in which water can be captured and retained), the joint eccentricity is a serious problem, the web setting in the joist is rigid, the existing finger joints have high stress peaks, the existing joints include harmful open routings, which make the joist unattractive, the existing joints include voids in the joint, which weaken the joint, the existing joints are unreliable and require a proof-loading, the existing joists do not make a structural connection with the cast slab above the joist. The present invention overcomes these drawbacks.

SUMMARY

The present disclosure is directed to an improved trussed joist that, at least in one embodiment, includes two chords with a lower (first) chord and an upper (second) chord being located a distance from each other. The upper and lower cords have inner faces opposite to each other and outer faces. There is a portion in the trussed joist that includes two elongated webs located between the inner faces of the chords. These webs can be considered to be a left web and a right web. The webs have outer edges (lower ends or faces) that lie closer to the lower chord and the webs have inner edges (upper ends or faces) closer to the upper chord. The upper ends of the webs are connected in the upper chord and the lower ends of the webs are connected in the lower chord. The chords and the webs make a crosswise opening that generally has about a triangular or trapezoid shape; however, this present disclosure is not limited to such shapes. The lower ends of the webs have at least one straight or tapering tenon finger and the lower chord has a matching mortise routing, wherein the tenon finger of each web is inserted using glue to make a joint to resist forces and moments of the joist. The disclosure also applies to an opposite case where the routing is in the upper chord.

The chords and webs can be and preferably are formed of a woody material at least in its trussed portion like sawn timber, LVL, glue lam, LSL, PSL, fibre board, OSB, CLT or their mixture. Glued trussed joists and joints are disclosed in U.S. Pat. Nos. 8,122,676, 8,424,577, 7,975,736, GB2038393, US2017/0234011, CA2335684 U.S. Pat. No. 3,452,502, US2005/0225172, each of which is hereby expressly incorporated by reference in its entirety.

As described herein, the present disclosure is directed to an improved joint, joist and method is disclosed here. Improved features of the present joist are that the chord routing goes through the chord, the glue areas are large, routings are open and go through the chord.

DETAILED DESCRIPTION OF CERTAIN EMBODIMENTS

Figure 1:
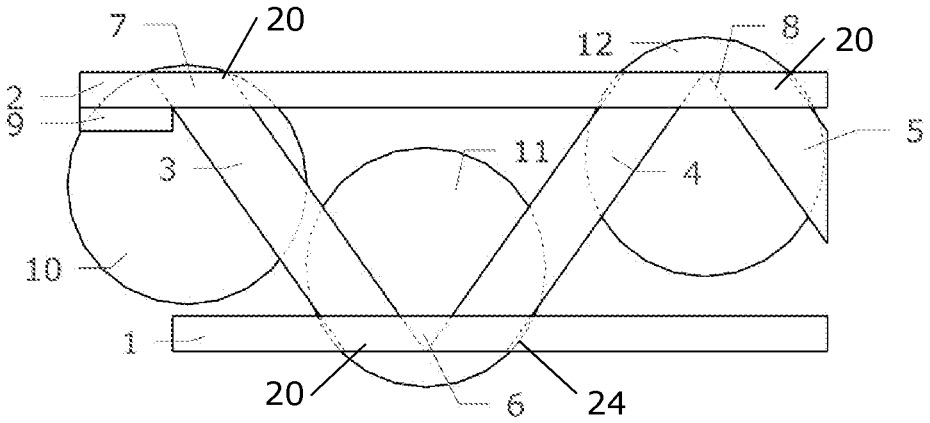
FIG. 1 represents a front view of one embodiment of a trussed joint in accordance with the present disclosure.

As previously mentioned, one feature of the trussed joist of the present disclosure is that the chord routing goes completely through the chord and the glue areas are large in the joint fingers. There are many means to obtain large glue areas: The webs or at least the tension web goes through the chord and especially the inner edge of the tension web goes through the chord or at least almost and at least the fingertips of the tension webs are visible at the outer chord face to allow for inner inspection thereof. As described herein in certain descriptions, the term inner refers to an edge, surface of face that is oriented such that it is closer to and engages one chord and alternatively, the term outer refers to an edge, surface or face that is oriented such that it faces an opposite direction and is closer to and engaged the other chord. The cross-sections of the webs or at least the cross-section of the tension web is flat with depth and can have a thickness ratio of about 3-8 (ratio of depth to thickness). This is an important feature of the present joist. Each web end has several fingers, normally two, but one-finger option is possible, too. The web fingers consist of planes parallel to the chord obtained in a routing process where the tool is a plane parallel to the chord or moved parallel to the chord. If the webs are connected to each other in the joint the inner edges of the webs normally cross at the upper face of the lower chord.

The joint is simple with minimal and even robust chord routing, especially regarding the routing lengths and the location in the chord, and the web fingers are simple, too. In an ultimate case with straight fingers the web fingers are not processed at all, i.e., a normal plank which is appropriately cut can be used as such. However, due to required measure accuracy in glued joints, some processing and at least some planning is needed to obtain the required fit in the tenon and the mortise finger. The web finger is often obtained by only one straight tool—web move in one direction only and in some other cases in two directions, no expensive and slow curved tool moves are normally needed.

The web assembly is simple too as the webs may be assembled apart from each other, especially in locations of minor shear loads in the joist like in the mid part of the joist, the cap between adjacent webs ends may be considerable up to about 10 cm. The chord routings may be excessively long and defined approximately to accommodate the flexible web setting.

In the present joint, the tension web end does not have "shoulders" i.e., the distance between the roots of the outermost fingers is almost the same as the web thickness and the web thickness is less than about 5% higher. The compressed web may have considerable shoulders.

The present joist normally is a trussed joist which includes web patterns i.e. similar consecutive ascending and descending webs. Often, there is only one web pattern or only few patterns and only one web type or only few types. The joist ends may have elongated verticals which make a unique web pattern which is different from the primary web patterns which normally include descending and ascending webs only. The joist ends may include sheet webs instead of elongated webs to facilitate trimming. The chords typically are fixed at a constant distance from each other and are straight or curved normally with constant curvature.

In the existing conventional glued trussed joints, the web finger ends inside the chord. The present finger goes up to the outer face or preferably almost to the outer face of the chord leaving normally recess about 1-3 mm for glue spatters and manufacturing tolerances (e.g., within 1-3 mm of the outer face of the chord). More particularly, as used herein −3 refers to the situation in which the finger end (fingertip) is recessed −3 from the outer face of the chord and conversely, and 0 refers to a situation in which the finger end is flush with the outer face of the chord, and +3 refers to a situation in which the finger end extends 3 mm beyond the outer face of the chord. Preferably, the finger end is within −3 to +3 mm from the outer face of the chord. In exposed applications it is feasible that the fingertips extend a little above the chord's outer face and the excess is removed. Thus, the web-chord glue area is larger, often manifold, and therefore the joint is stronger. It brings many other advantages too, such as, the webs may be fixed apart from each other with variable distance, the transverse opening is large, the web assembly is easy, the joint resists high eccentricity stresses and excess stresses due to voids and open routing ends.

One embodiment, especially suitable for long spans or heavy loads or for cases where a ductile joist behaviour is required, is that the joist includes two web types only. One, appropriate for compressed webs "compressed web", is used in the joist ends and the other web type "general web" is applied in all other cases. Normally, the joist has only a few or even one compressed web at either end of the joist and all other webs are of type two. The joist has only two joint types with two webs, one with compressed web+general web where the webs are in contact and the other joint type with general web+general web where the webs are apart. The thickness in the general web is less and the web-chord glue area larger than in the compressed web. These two web types normally have the same pitch or at least about the same pitch regarding the chord. If the pitches are different, the compressed web has higher pitch (i.e., it's angle regarding the chord is higher). The joist may include sheet webs at least in one joist end to accommodate trimming and in some rare cases the joist end may have vertical end webs.

In some cases, e.g. cases of long spans and heavy loads the joist includes at least two adjacent web patterns, normally even number of web patterns fixed side by side in the same chords with similar webs (normally only two web types or only one type) and similar pitches (at least similar pitches in similar web types) regarding the chords and fixed to start differently in the joist ends, one pattern starts from the joist end as an ascending web and the other as a descending web. This means that the joist includes successive webs in X-shape, one web in tension and the other in compression (See, FIGS. 18A-C). The adjacent X-webs are not normally connected to each other but can be connected in the crossing point mainly to facilitate the buckling of the compressed web especially in cases with high joist depth. The advantage in the X-concept is that the bay length i.e. the distance between the node points (distance between the routings) halves and the moment stresses in the chords decrease to about one quarter i.e. more or less vanish and the buckling length halves. The joist ends include verticals. The joist has in the middle a transition zone where the web patterns in either ends of the joist meet and where the web alignment does not resemble X as the web patterns usually do not match the required joist length.

The routing tool may be selected such that the routing is obtained by moving the tool regarding the chord (alternatively moving the chord regarding the tool) in one direction only (i.e., perpendicular to the chord and without a relative tool-chord move in the chord direction). This makes the routing fast, simple, inexpensive, and accurate, typically the speed about doubles and the cost halves as the routing apparatus is inexpensive. This is a major advantage as the chord routing is a considerable cost.

In a glued joint, it is fatal if the glue is missing due to an error in the glue application. In the present chord routing, routing is open at the outer faces of the chords with visible web fingertips which can be used to check if the glue is applied correctly in the fingertip and probably in the whole finger, too. Often, the fingers are visible at the finger edges (and sometimes between the webs too) as the routings extend beyond the outer edges of the webs to make open routing ends. Thus, the checking can apply 1-3 sides of the web finger. This checking can be easily be made automatically using a camera which reliably detects the glue. This checking is especially effective if the glue is applied in the chord routings. Other checks, like geometry and defects in fingers, can be made, too.

The upper chord support in a glued trussed joist is challenging. US2017/0234011 discloses one embodiment which has two disadvantages: the routings extend beyond the web and weakens the chord in a critical point i.e. in the support overhang root and the finger's glue area is inadequate. When the chord routing is processed from the outer face of the upper chord, the chord routing weakening is avoided in the critical point and the glue area is larger.

Timber joists should not get wet not at least for long periods; however, such demand is not always fulfilled, and possible water pockets make a risk for timber and joint deterioration. The water pockets can be avoided in the present invention using two alternative methods: the joints are made without open routings or the open routings go through the chord and the water may run through the chords. Therefore, the present joist can be used outdoors, which is a unique feature.

In the existing glued timber trussed joints, the routings are shallow and therefore the web centre lines do not cross at the chord centre line and normally the web centre lines cross above the chord centre line i.e. the joint has harmful positive eccentricity. Many existing joints like US2005/0225172 are designed for a non-existent or negligible joint eccentricity. Such approach results in complicated joints with several routing processes and very harmful chord perpendicular to grain failures in the web's fingertip or the glue line failure in the inner edge of the tension web. The present joint can easily be made to avoid the eccentricity. However, the present joint often has high negative eccentricity which is the outcome of the webs fixed apart from each other. Such high eccentricity and reduced resistance are possible in the present joint as the glue areas are large and the load resistance is adequate.

Figure 17:
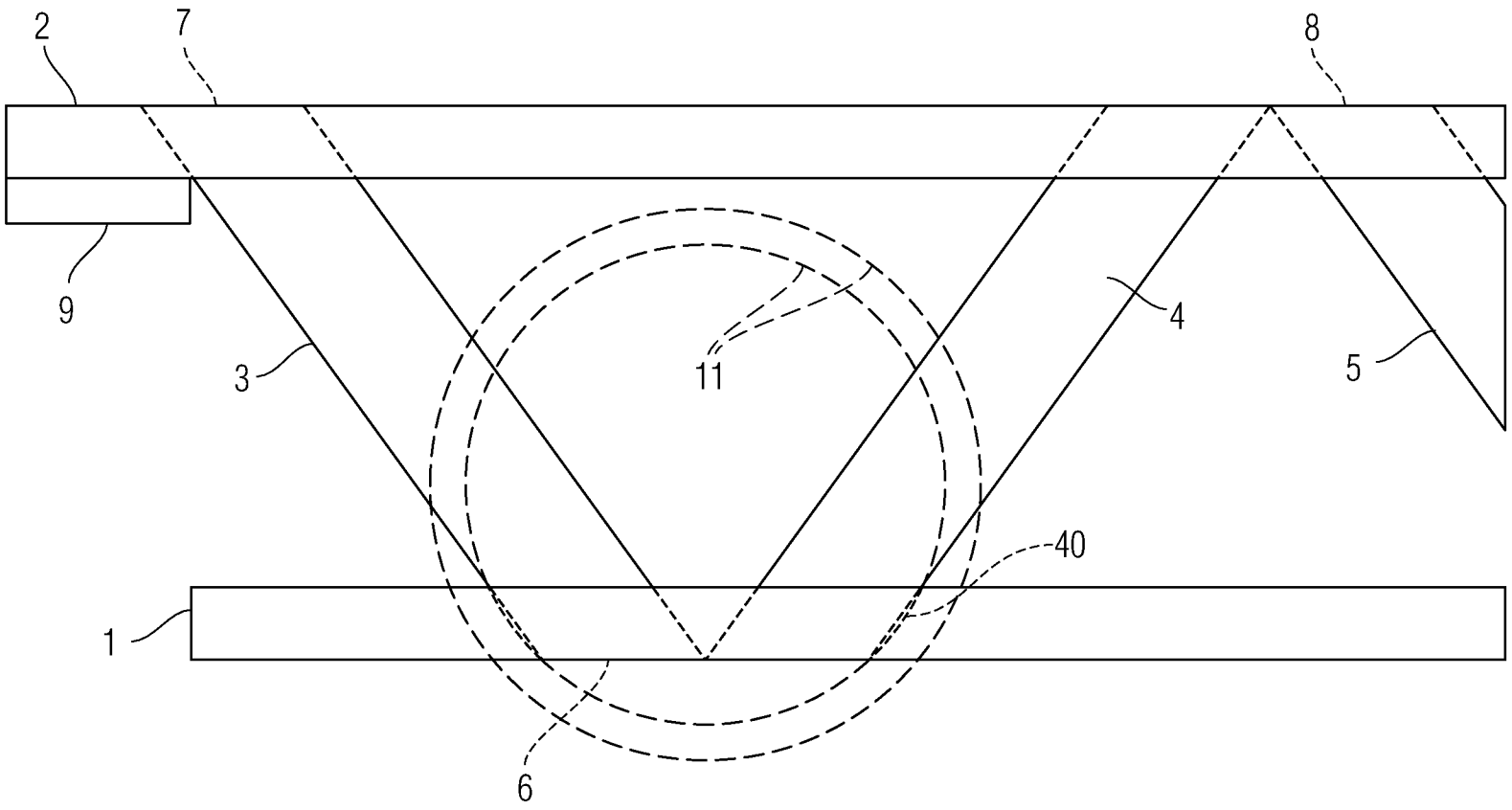
FIG. 17 is a side view showing two different alternative sized routings formed in the chord.

In the existing joints, webs are connected to each other, no flexibility exists regarding the web pattern. In the present joint, the webs may be fixed in contact or apart from each other. Fixing the webs apart makes harmful eccentricity stresses, the present joint resists these stresses as the glue areas are large. Such web setting may be used to increase the web spacing to save timber or to obtain larger crosswise openings or to adjust the webs to the supports or crosswise pipes. Setting the webs at a variable distance to each other is known per se. One aspect and feature disclosed herein is that the adjacent webs, one ascending and other descending regarding the chord, are fixed in the same chord routing and the routing goes through the chord and the routings are open through the chord at the routing ends (See, FIG. 17 showing one embodiment in which gaps are formed between the webs and the end walls of the routing).

In finger joints, high stress peaks occur in the fingertips and these stress peaks mainly govern the whole resistance according to the fracture mechanics in the tenon finger. Such high stress peaks are essentially lower when the fingertip is in the outer chord face or almost. Thus, the resistance is high in the present joint firstly due to large glue areas and secondly due to less stress peaks and smoother stress distribution over the glue area as the fingertips are not inside the chord and especially the fingertips of the tension webs are not inside the chord.

The existing joints normally have harmful open routings and voids in the joint. The present joint can easily be made without any open routings and voids. However, the present joint is often made with open routings and sometimes with voids to ease the joint manufacture or to obtain flexibility in the web setting. The present joint has such overall high strength that the weakening due to the open routings and the voids is not too harmful.

The existing glued trussed joists are proof-loaded due to their unreliability due to glue line failure or the chord failure along the web fingertip. The present joint has a large glue area, often manifold glue area, and the web fingertip is in the chord's outer face or almost and therefore the chord failure is not possible along the fingertip, thus, the overall reliability is good, and proof-loading is not needed.

In the present joint there are two new methods for the quality assurance: Firstly, the fingertip is visible at the outer faces which can be used to check if the glue is correctly applied in the tips and probably in the whole joint, too. Secondly, the glue areas are large, normally at least about the chord depth (chord height) or almost the chord depth by about 1.4 times the web depth and normally at least about 35 mm*60 mm in each finger. This area is bigger than in any existing joint where the web finger ends in the chord. A test sample can be bored through the fingers with a small diameter less than about half chord depth (e.g. about 10-20 mm) where the quality of the glue lines can be checked using normal techniques. A simple remark is if the intended glue line has glue or not and when the sample is ripped apart the failure should not occur according to current standard rules in the glue area, not at least fully. The boring can be made horizontally through the chord but normally inclined boring with chord upper face—boring direction pitch less than about 45 degrees is appropriate. When the bored hole is filled with a timber dowel glued in the hole, such hole makes no or only a negligible harm for the strength.

Glued trussed joists are often used as a floor joist with a cast concrete slab. Sometimes, a structural connection is made between the joist and the slab, but such connection requires effective shear resistance between the joist and the slab. Nailed, screwed or bored dowels or notches in the joist are normally used. In the current joist, the notches are obtained simply by making the routing from the outer face of the upper chord and by leaving the finger routings open or extra routings may be made simply using the same equipment which makes the finger routings. Further, the fingertips may extend above the upper chord face to make shear anchors which can be used as sole or additional anchors.

The existing glued trussed joists have a harmful brittle failure and therefore some authorities are reluctant to accept glued trusses for long spans, higher than about 10 m and heavy loads. The present joist normally is brittle, but it has a ductile version, too and therefor it can be used for spans up to about 30 m and for heavy loads e.g. for cases of high spacings, higher than normal 600 mm and for girders and for door and window lintels. In the present joint, the ductile failure is obtained by fixing a small glue area in the compressed web and larger in the tension web. As the load increases the glued joint of the compressed web at least partly fails and the compressed force transfers to contact and joint slip and joist deflection increases considerably i.e. a ductile performance occurs which can be detected easily by increased deflection of the joist and precaution measures may be taken. The partial failure of the compressed web joint makes excess stresses in the tension joint and therefore the tension joint must be especially strong. The glue areas in the present joint are large and the failure in the chord is not possible the excess strength exists. Thus, the overall joint and joist behaviour is ductile which is a unique feature in glued trussed joists and opens new use areas for glued trussed joists. Normally, it is adequate that only a few joints or sometimes even one joint in either joist end is made ductile.

Joists are often made of sawn timber which has defects like knots and inclined grain. Joints of the existing glued trussed joists are small. If a defect hits the joint, the resistance considerably decreases or almost vanishes. In the present joist the joint extends through the chord. Defects are local and newer extend through the chord. Therefore, the present joist is more reliable as the defects can make only a minor decrease in the resistance.

A joint of a glued trussed joist normally has two webs, one in tension and the other in compression. The upper edge of the tension web is critical for the overall strength. The upper edge must be fixed deep into the chord, preferably through the chord, to avoid the chord cleavage along grain at web's fingertip or the glue line failure. This edge must not be connected either to the compressed web (e.g. according to U.S. Pat. No. 3,452,502 as the compressed web bursts). In the present joint, the upper edge of the tension web is connected deep in the chord i.e. up to the outer face, and the present joint fails by break in the finger root, i.e. the break is a normal timber failure. Timber failure is well known in research and in the structural codes which is one reason, the present joist does not need a proof-loading. In some embodiments the tension and the compression web overlap and one half of the upper edge is removed, which theoretically even halves the resistance. However, this is a minor deficiency which can be overcome by increasing the web cross section or high strength web material is used.

In the existing glued trussed joints, the web fingers cut about 10% of the chord fibres. In the present joints this number is normally higher and therefore the fingers should be thin and the web thickness thin, too, which is another reason the web's depth-thickness ratio must be high at least in the tension web. To obtain sufficient strength in the webs with small cross-sections the web material must have high strength land thus be formed of a material, such as graded sawn wood, LVL, LSL, PSL, etc., at least in the tension webs.

The upper edge of the tension web in the current joint is reliable due to the long finger and large glue area but the performance is increased further when the glue is applied in the finger edge, too. This embodiment secures a tight joint which is reliably watertight and good-looking.

Glued trussed joists often have I-joist portions in the joist ends with sheet webs like OSB-sheet webs, which allow trimmable ends. One deficiency in the existing joists is that the sheet web must be connected to the first truss web. When the first truss web extends between the outer faces of the chords, connection of the sheet web to the truss web is not needed as the truss web reliably secures the joist end and a small gap of some millimetres or even centimetres may occur between the webs. When two normal I-joist's sheet webs, e.g. 9-12 mm OSB sheet, are fixed at least a couple of centimetres apart from each other in the joist ends and finger jointed deeply in the chords at least about 66%, and preferably 100%, of the chord depth, the joist is trimmable and can be supported in the upper chord, too. The double sheet webs make the joist very reliable which is one further reason the joist does not need a proof-loading.

In the present joint an expandable glue, like PUR, is normally applied but other structural adhesives like PRF, MU, MUF can be used, too.

There are several strategies for making and processing the present joint:

selecting the tool, tapering vs straight finger, open vs closed routing ends, if the routing ends are open, do they go through the chord, is the routing processed from the inner or from the outer face of the chord, moving the tool in the chord direction or perpendicular to the chord only, selecting the tool diameter individually for each joist or suitably for several joists, is the joint made without eccentricity, if eccentricity exists, is it positive or negative, how many fingers each web includes.

The routing tool may be a normal finger joint cursor to make a tapering finger. Such tool is inexpensive, and the processing is fast but used in special cases only as such tool has several disadvantages, the major disadvantage is that this joint has long open routings beyond the web edges. A tool cutting in its outer perimeter only, like a saw blade, making straight or tapering finger is normally applied. If the finger is tapering the routing must be made at least in two tilt positions of the saw blade. For this reason, the fingertip is normally about a half finger root when two routings in two tilt positions only are needed. Chain saw can be used, too. Though its low cost and fast routing, it is used in special cases only due to poor routing quality and the weak resistance of the tool.

The finger is normally tapering due to high joint strength, easy web assembly, reliable glue application, good gluing result and the wedge effect by the tapering fingers fix the webs and the chords reliably together to move the joist from the assembly jig before the glue cures. A straight finger can be used too, due to its simple, cheap and fast routing.

The routing ends are normally open as it allows simple routing, allows checking the validity of the fingers and the same tool can be used for several joints and one apparatus with one axle and several adjacent tools can process routings for several fingers and even several chords. If the routing ends are open, they are normally open through the chord, i.e. no water pockets occur. Often the webs are assembled apart from each other, thus there is an open routing in the middle of the joint and this routing is normally open through the chord, too.

The routings can be processed from the inner or the outer faces of the chords. The upper chords are often processed from the outer faces as it allows an effective upper support for the joist and notches for potential concrete casting. To obtain the best routing flexibility and least open routings, the tool diameter is selected smallest feasible, tool diameter of about 120 mm is minimum in normal cases with the chord depth about 40 mm. This number can be derived from the minimum axle diameter of about 25 mm, tool fastener diameter of about 35 mm and a required play about 5 mm.

In the mass production of the joist, the routing tool moves in the processing perpendicular to the chord only either perpendicular to the chord faces or inclined i.e. without a relative move between the tool and the chord. Such processing is fast, inexpensive and simple.

Normally, the tool diameter is large enough to process several joist types, which results in open routing ends through the chord. In special cases, the tool diameter is small which allows closed routing ends when the routing path is directed according to web edges. This process is slow and the routing apparatus expensive as the tool must move relative to the chord direction.

The webs normally have two fingers but can have more fingers or even one finger. No existing glued trussed joist currently in the market has one finger only which is due to insufficient glue area and the glue line failure in the tenon finger or the chord splitting failure at the fingertip. The present joint has high glue area and the chord failure is not possible, the joint can be made without eccentricity and without open routings and voids and therefore the present joint may have one finger only which is a unique feature.

Figure 9:
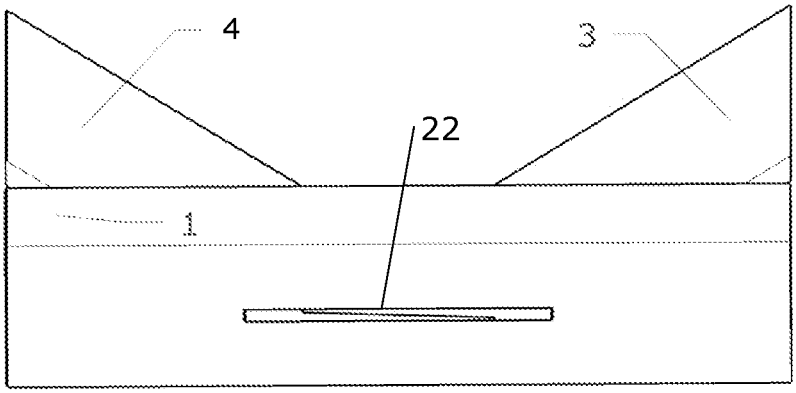
FIG. 9 represents a perspective view diagonally from down of FIG. 7.
Figure 10:
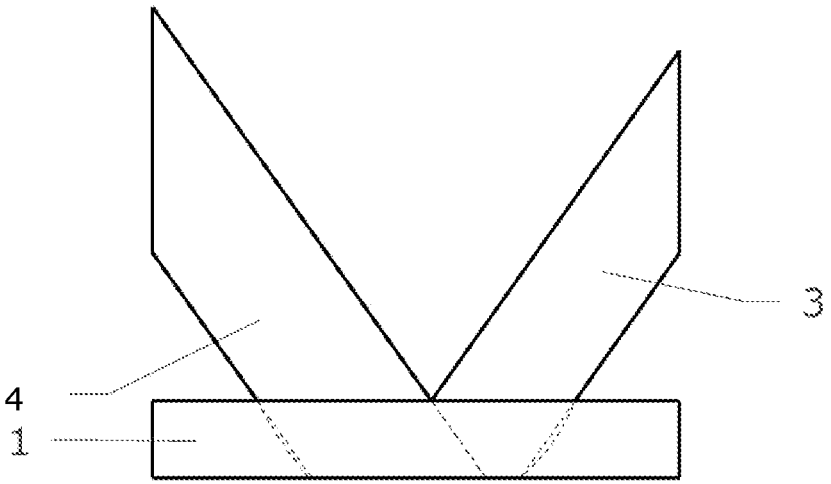
FIG. 10 represents a front view of a joint for a robust application.
Figure 11:
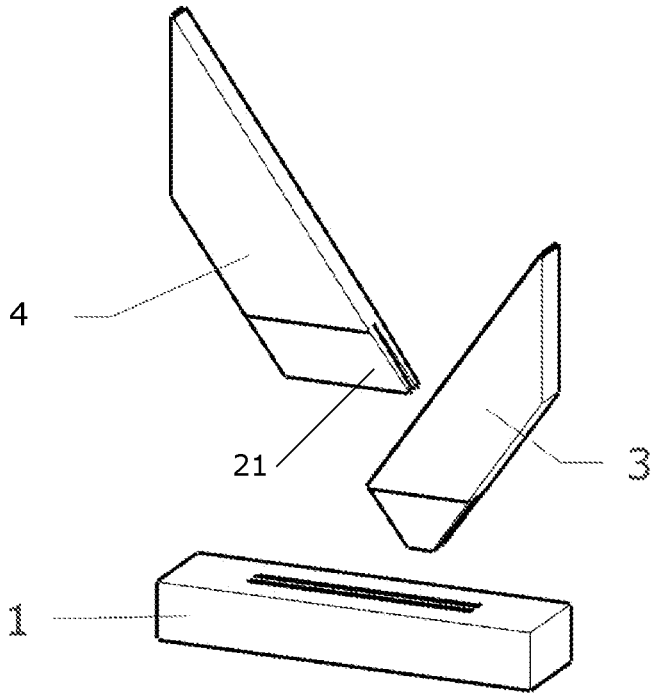
FIG. 11 represents a perspective exploded view diagonally from up of FIG. 10.

Glued trussed joists are sometimes used in cases with high point loads like joists to support concrete cast. In the existing joists the chord depth is about 60 mm. In the present joist the web finger extends to the chords outer face which makes high compression strength in the chord and the joint strength is high, too and therefore the chord depth can be considerably lower up to about 40 mm with a considerable material saving. A good outcome is obtained when the joist has two adjacent webs, either parallel or in X-shape at either side of the chord and the web has only one finger preferably according to FIGS. 7, 8 and 9. However, in this application the inner edges of the webs may cross above the inner face of the chord. The joint disclosed in FIGS. 10 and 11 is feasible, too due to its simplicity and low material cost.

Figure 2:
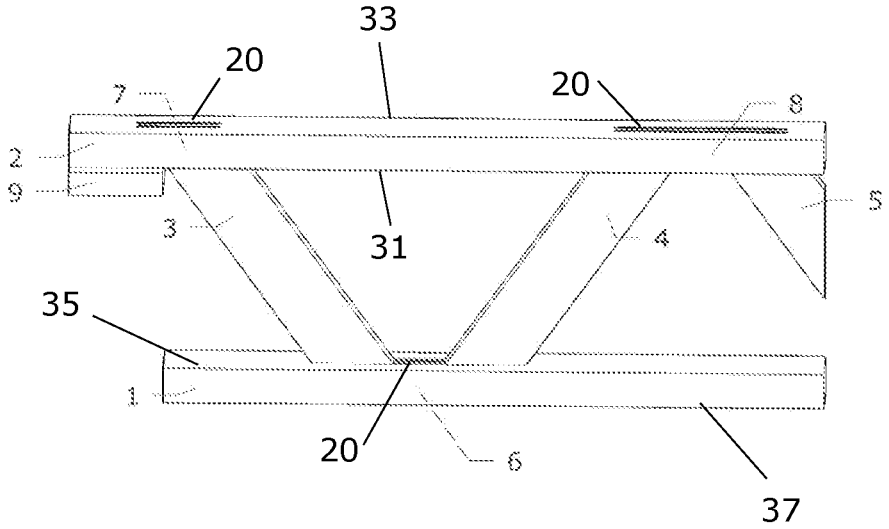
FIG. 2 represents a perspective view diagonally from up of FIG. 1.
Figure 3:
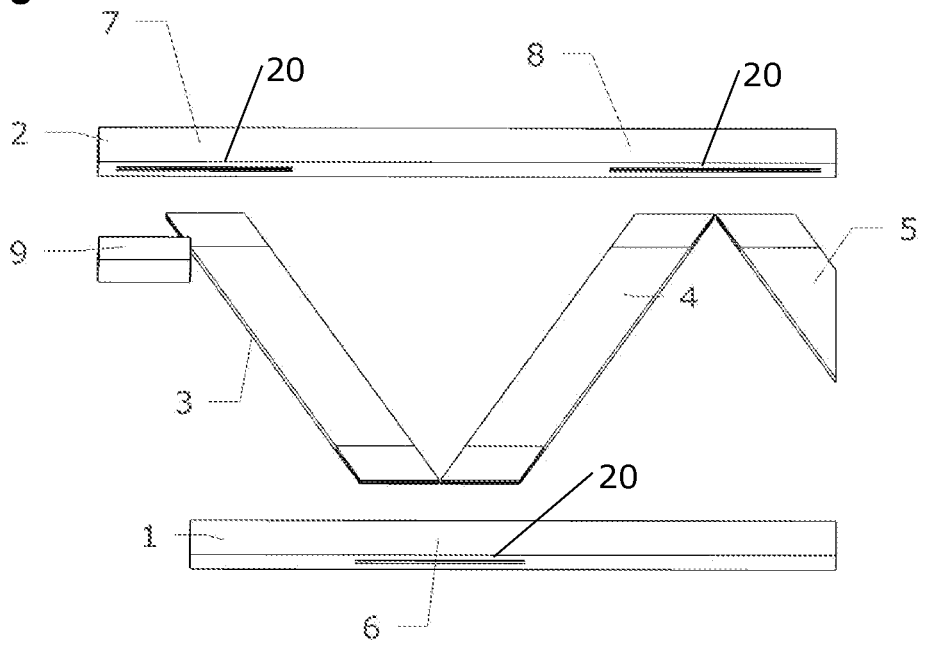
FIG. 3 represents a perspective view diagonally from down of FIG. 1 with the chords moved.

Now referring to the drawing figures in which various embodiments are shown. FIGS. 1, 2 and 3 show a left end of a joist which has a lower (second) chord 1, an upper (first) chord 2, webs 3, 4 and 5, routings 20 and joints 6, 7 and 8. As is known, a joint is a location where one or more webs are attached to a chord. The support of the joist is depicted by a lath 9. Labels 10, 11 and 12 show a routing tool, in this case a saw blade, in the utmost routing position. As is known, these routing tools operate on the chords 1, 2 to form defined routings 20 therein. The tool 10, 11, 12 passes completely through the chords 1, 2 which is one feature of the presently disclosed joint/joist in that in at least one embodiment, the routings are open along opposing faces of the chord 1, 2. In FIG. 2, an inner face of the second chord 2 is represented by 31 and the opposite outer face of the second chord 2 is represented by 33 and similarly, the inner face of the first chord 1 is represented by 35 and the opposite outer face of the first chord 1 is represented by 37.

The diameter of the tools 10, 11 and 12 can be the same and the diameter can be fixed in such way that the routing 20 in joints 6 and 8 match the outer edges of the webs 3, 4 and 5 in the inner and the outer face of chords 1 and 2 but there are small voids inside the chords. In the joint 7, the tool matches the edges of the web 3 only at the outer face of the chord 2. Thus, a routing is obtained which has no open routings in the routing ends, i.e. there is no water pockets and the joint is strong as gaps and open routings reduce the joint resistance. Such routing is simple and fast as the routing tool moves perpendicular to the chord only i.e. without any relative move regarding the chord in the chord direction. In this routing there are small invisible and harmless voids at the routing ends inside chords. Alternatively, a tool with smaller diameter is used and the routing track is guided along the outer edges of the webs to avoid voids and open routing ends. In this case, the routings are open between the webs 3-4 and 4-5 and therefore it is preferable to fix the webs apart from each other so that the water runs through the chords. Another feasible embodiment is that the routing ends have a small gap, which allows several advantages, including but not limited to the tool can be used for several joist types e.g. several joist depths. The routing precision may be robust regarding the routing length and the location in the chord, and no water pockets occur as the water runs through the chord. If the gap is small, it makes only a little resistance decrease. In the joint 7, the tool 10 goes through the chord 2 only an amount which is necessary to make a routing for the web 3. This routing makes a harmful open routing above the support 9, which weakens the chord and the joint and therefore the routing is made as small tool as possible. Such joint weakening can be avoided by gluing fillings in the routings or extra web which is appropriately cut.

Figure 4:
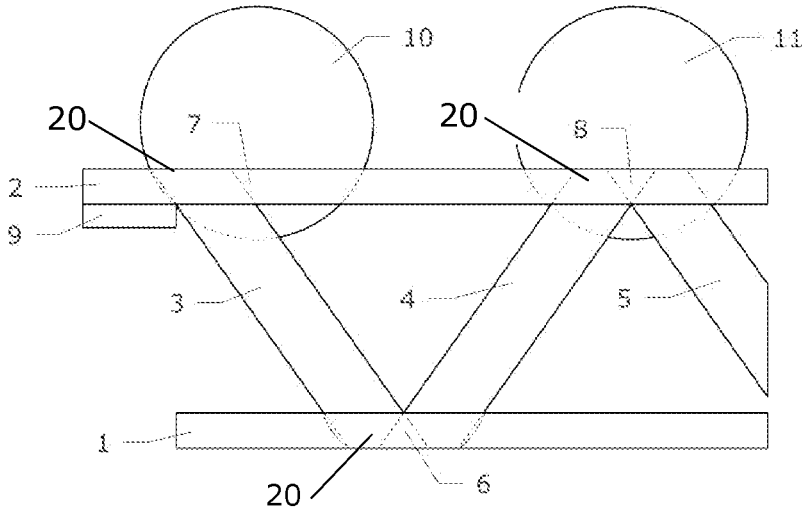
FIG. 4 represents a front view of another embodiment of the present disclosure.
Figure 5:
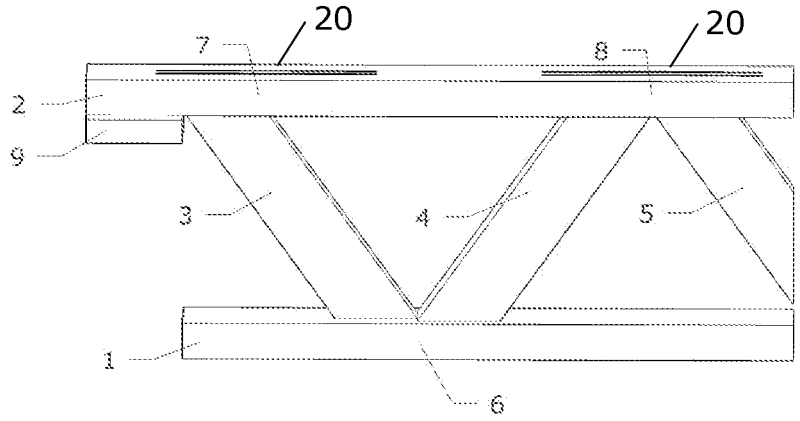
FIG. 5 represents a perspective view diagonally from up of FIG. 4.
Figure 6:
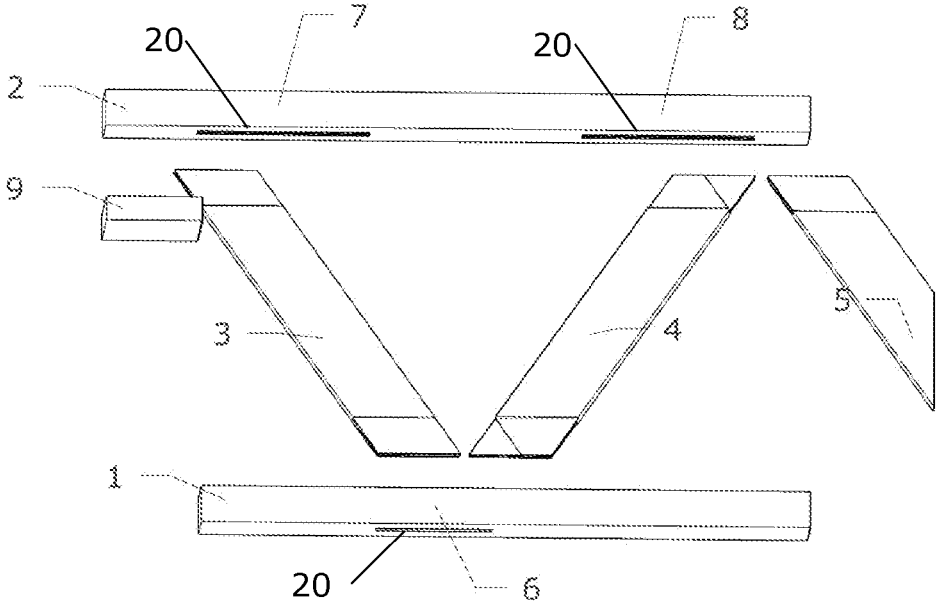
FIG. 6 represents a perspective view diagonally from down of FIG. 4 with the chords moved.

FIGS. 4, 5 and 6 show left end of another joist with chords 1 and 2, webs 3, 4 and 5 and routings 20 and joints 6, 7 and 8 and support 9. Labels 10 and 11 show a routing tool, in this case a saw blade, which processes the chord routings from the outer face 33 of the upper chord 2. There are long open routings 20 at the outer face 33 of the upper chord 2 and therefore it is feasible to adjust the tool diameter as small as feasible, normally less than about 120 mm. In this example, the tool moves in one direction only regarding the chord 2 but better outcome i.e. lesser open routings, are obtained when the tool diameter is small and moves in the in the chord direction, too. The open routings 20 may be used as anchors for a concrete slab eventually cast on the joist. The tool 10 is located to make as small routing above the support as possible (e.g. by guiding the tool along the left edge of web 3). The routing 20 is big on the right weakening the chord on the right, but this deficiency is minor considering advantages in the chord strength on the left and web strength. Support 9 works as an overhang regarding the joint and makes high stresses in the overhang root i.e. at the outer edge of web 3. Therefore, this point should have as little routing as possible.

Figure 7:
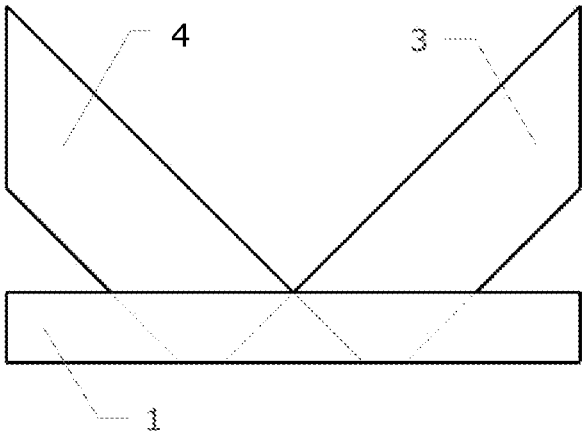
FIG. 7 represents a front view of a joint with one finger.
Figure 8:
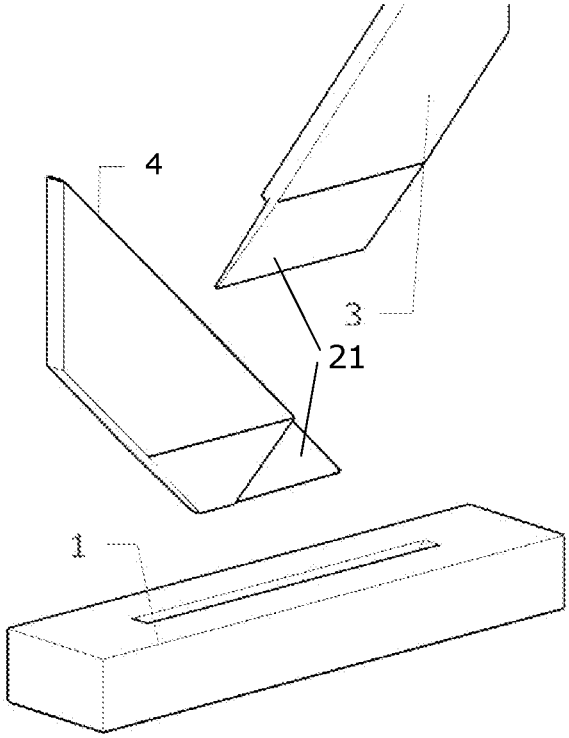
FIG. 8 represents an exploded perspective view diagonally from up of FIG. 7.

FIG. 7 shows a front view of a joint with one finger 21 with chord 1, and webs 3 and 4. FIG. 8 shows its perspective view with the parts apart and FIG. 9 shows the joint diagonally from down. The webs 3, 4 are similar with one end cut which makes a sharp angle with the chord. The peak parts 21 at the web ends are sliced so that the peak parts overlap in the joint. The slicing plane normally has a little angle regarding the chord direction in order to obtain a tapering finger in the chord direction, which is seen in FIG. 9 where the inclined slicing line 22 between the fingertips of webs 3 and 4 is visible. It is essential that the upper edges of the webs 4 and 3 cross at the upper face of the chord 1. Normally, the present joints are not self-locking but the joist including joints like explained here can be assembled simply by pressing the chords to each other. The inclined slicing is especially practical for cases with straight fingers as the inclined slicing tightens the joint before glue cures. This joint is a full match joint (i.e., full match is in the chord routing-web fingers and between web fingers without gaps and voids within normal wood processing accuracy and gap allowance of structural glue normally less than about 0.5-1 mm and glue is applied in all contact areas). The one-finger joint represents an ideal joint, simple to make with high material efficiency e.g. two webs with one finger is much stronger than one web with two fingers. The embodiment explained here is good as both webs are identical, the joist is symmetric and can be turned around i.e. the upper chord becomes the lower chord and vice versa. One alteration of this joint is that the web ends are not sliced symmetrically but the tension web has more timber in the joint and slicing plane hits the upper edge of the tension web more at the tension web side e.g. in about the two thirds point. In this joint both webs have the same glue area, but the behaviour is ductile as initial failure occurs in the upper edge of the compression web with increased joist deflection. This concept can be applied in joints with several fingers, too. Another feasible one-finger embodiment is that all webs are similar and have one end cut only and are assembled apart from each other (i.e., the webs are like webs 4 and 3 without the peak slicing and disclosed in FIGS. 1, 2 and 3). However, better strength is obtained when the tension and the compression webs are dissimilar and this joint is normally applied in the joist ends and the tension web has one end cut and is similar as webs 4 and 3 without peak slicing and goes through the chord and the compression web has two end cuts, one is perpendicular to the tension web and the other approximately perpendicular to the chord (i.e. it makes a dull peak, i.e. the angle between the two end cuts is more than 90 degrees, in the web end) and the webs are assembled in contact with each other, the concept is shown in FIGS. 10 and 11. No glued trussed joist with one finger only exists in the market. The present joint is strong enough with one finger only and offers new and unique material efficiency, economy and simplicity.

FIG. 10 shows a front view of a joint which is suitable for robust cases like long spans and heavy loads and cases where a ductile joist behaviour is required. The joint has chord 1 and webs 4 and 3. FIG. 11 shows its perspective view with the parts 1, 4, 3 apart. The webs 4, 3 have about the same cross section area and the web 4 is thinner with higher web-chord glue area and set to be in tension and web 3 is in compression and smaller web-chord glue area. This joint is not self-locking, or it is poorly self-locking in the assembly. Therefore, it is useful to adjust the routing ends to match the outer edges of the webs 4 and 3 which makes the joint self-locking. A little stronger joint but more complicated to assemble is obtained when the web 3 has one end cut and the peak portions 21 are sliced and overlapped in the same way as in FIGS. 7, 8 and 9. As is known, a glue area is an area of the web that lies within the chord on which glue is placed for gluing the web to the chord material that is in contact with the web. This joint is self-locking though the routings are open in the ends. This joint can be a full match joint which is a feasible option.

Figure 12:
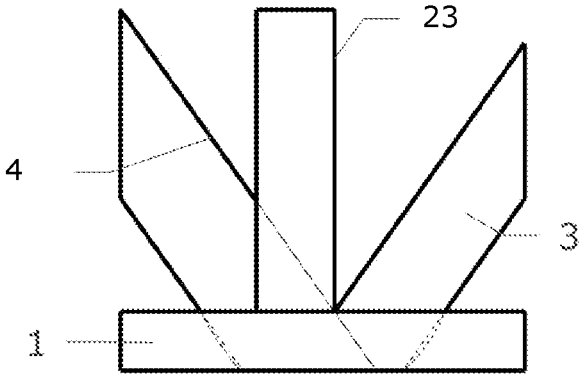
FIG. 12 represents a front view of a joint with three webs.
Figure 13:
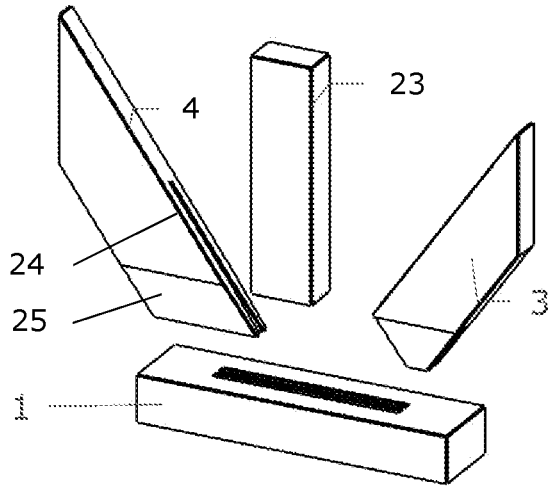
FIG. 13 represents an exploded view diagonally from up and right of FIG. 12.
Figure 14:
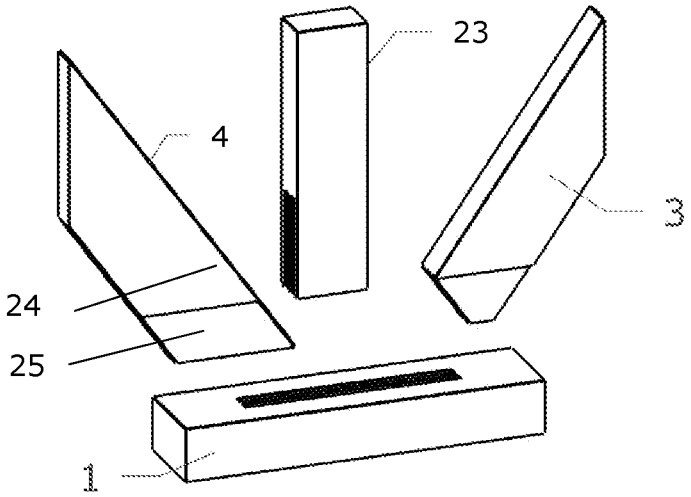
FIG. 14 represents a perspective exploded view diagonally from up and left of FIG. 12.

FIG. 12 shows front view of a joint which is similar as the joint in FIG. 10 but a web 23 is added. FIG. 13 and FIG. 14 are perspective views of the joint. The web 23 is connected to the web 4 by straight fingers 24, which continues to the chord 2 preferably as tapering fingers 25. This joint is workable without the web 3 (i.e. only the tension web is joined to the chord 1 and the compression web 23, thicker than the tension web 4 is connected to the tension web using straight fingers). One modification is that the web 3 is not joined to the chord but to the web 4 when the web 23 is moved to left to leave space for the web 3. These two webs are joined in the same fingers 24 in the web 4. Another modification is that no web goes through the chord 1 but normally it is advantageous, that at least the tension web 4 goes through the chord 1. This joint can be a full match joint which is a feasible option.

Figure 15:
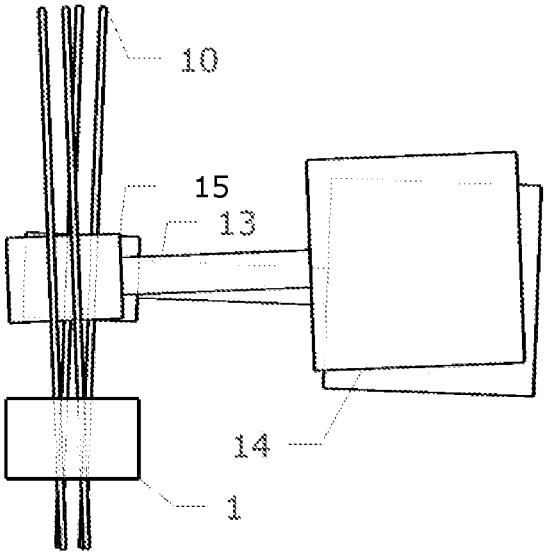
FIG. 15 represents a view in the chord direction which is an illustration for the routing.
Figure 16:
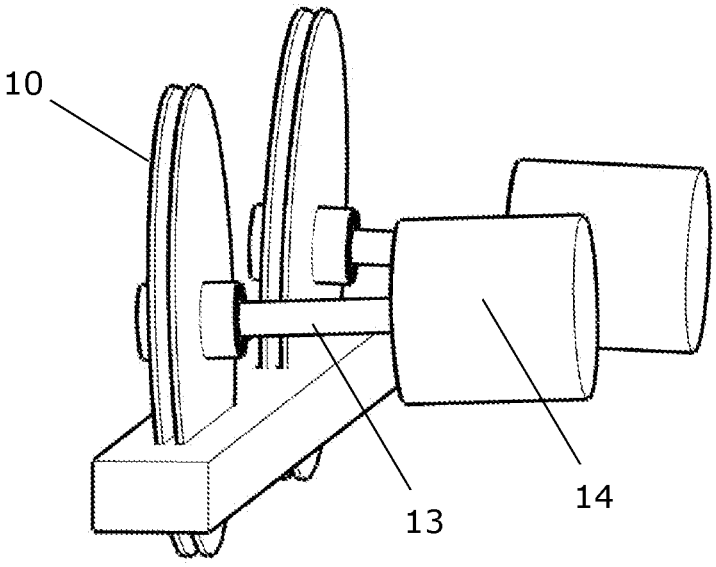
FIG. 16 represents an illustration for the routing process.

FIG. 15 shows a rough illustration of the routing principle in chord direction which include chord 1, saw blade 10, rotating motor or bearing 14, axle 13 and blade fastener 15. Two units the first one in up position (the motor is up regarding the blade) and the other in down position operate consecutively, when the chord 1 is moved successively to the routing locations (or vice versa), the first one processes one side of the mortise finger and the second one the other side. One axle may have multiple blades to facilitate effective routing. Normally the blade diameter is large enough or selected to be large enough that the axle has a bearing and fixing at the other end i.e. in this case at the left end as it improves the routing accuracy and lessens vibration problems common in routings. Normally, the routing in the present joint need not be accurate i.e. the routing length and the routing location along the chords can be approximate. However, is some cases e.g. exposed joist or joist without open routings and voids, and in full match joints high accuracy is needed which is difficult in timber where the measures vary due to moisture variations. Therefore, the routing is made by fixing the chord and moving the routing apparatus regarding the chord. The production line is short, approximately the maximum chord length, in this option whereas about double maximum chord length in the other option. One important option, which offers high flexibility and good accuracy, is that neither the routing apparatus is moved between the two routings needed for one joint when the motors are at both sides of the chord in down positions and the routings and made consecutively to each chord routing. If the finger is straight, only one routing station is needed. As the chord routing and the web assembly are major costs a feasible option is to make a robust joist and slice it afterwards, e.g. the chords are 38*148 mm*mm, three adjacent webs are assembled therein. Then the joist is sliced to make three joists with the chords about 38*47 mm*mm. It is feasible that robust joists are kept in stock at the factory, at the lumber yard or at the building site and joists with required chord thicknesses and lengths are sliced accordingly.

FIG. 17 illustrates a number of features of the disclosed invention. In particular, FIG. 17 illustrates the use of two different sized tools (saw blades) to form two different profiled routings in the lower chord 1. In the first embodiment, a smaller sized tool (smaller diameter saw) is used and is represented in the figure by the inner dashed circle. In this embodiment, the routing is formed such that a close fit is crated between webs 3, 4 and the chord 1 within the joint. In particular, the routing can be characterized as being a closed ended routing since the ends of the routing (routing end walls) that is formed in the chord 1 are in contact with the webs 3, 4. In FIG. 17, these routing ends walls are located where the inner dashed circle passes through the chord 1. For example, as shown in FIG. 17, the web 3 is in contact with the end of the routing at two points (two points of contact-defined as points of intersection between the web and the inner dashed circle which is the location of the routing end wall) with a small void (open space) 40 being formed and defined between these two points of contact between the web 3 and the chord 1. Similarly, the opposite end of the routing is in contact with the web 4 such as at two points of contact with the small void 40 being formed and defined between these two points of contact. The tool is thus sized so that at the opening of the routing along the inner face (top) of the chord 1, the webs 3, 4 contact the respective two ends of the routing and similarly, at the opening of the routing along the outer face (bottom) of the chord 1, the webs 3, 4 contact the respective two ends of the routing formed through the chord 1. As a result, two voids 40 are formed at the respective opposite two ends of the routing as shown in FIG. 17.

In a second embodiment, a larger sized tool (larger diameter saw) is used to form the routing. This is represented in FIG. 17 by the outer dashed circle. As can be seen in FIG. 17, when using this larger sized tool, the webs 3, 4 do not contact the ends of the routing but instead, the two ends of the routing are open. In other words, the webs 3, 4 do not contact the (curved) end walls that define the routing but instead the webs 3, 4 are spaced from these ends walls and therefore, in this sense the routing ends are open since there is an open space (gap) between the webs 3, 4 and the routing ends. In FIG. 17, these routing ends walls are located where the outer dashed circle passes through the chord 1. As described herein, these open routing ends provide a number of advantages including providing a continuous fluid path (water drainage pathway) that extends from the inner face 35 of the chord 1 to the outer face 37 of the chord 1. Any fluid, such as water, that enters the routing at the inner face of the chord 1 flows within these open-end spaces to the outer face 37 of the chord 1 where the fluid exits. From either a top or bottom view, a person can see right through the routing in these open routing end portions (there is a continuous opening from the outer face 37 to the inner face 35). The advantages of this type of construction is described herein.

For example, the open nature of the routing provides for a method for performing quality assurance of an integrity of a joint of a trussed joist that includes a chord with an inner face and opposite outer face and at least one straight or tapering mortise finger in the chord and at least two webs, with tenon fingers matching with a mortise routing formed through the chord, wherein the at least two webs are inserted from an inner side of the chord in the mortise routing and glue is used to make the joint resistive to stresses in the joist, the method is defined by the step of:

visually checking for an existence of the glue in the tenon fingers by inspecting tips of the tenon fingers from an outer face of the mortise routing that is open along the outer face of the chord.

Alternatively, a test sample can be bored through the glue lines of the fingers and the validity of the joint is resolved by inspecting the sample.

Figure 18A:
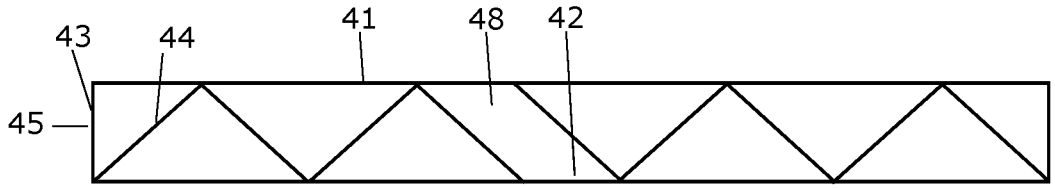
FIGS. 18A-C depict a joist with webs in an X-shape.
Figure 18B:
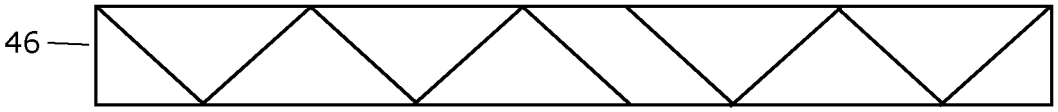
Figure 18C:
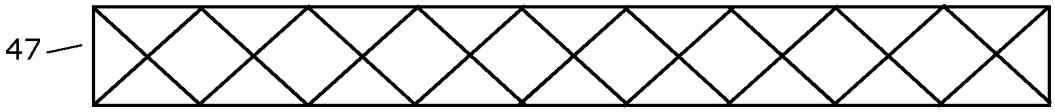

In another aspect of the present disclosure, it will be appreciated that an open gap or space can be provided only at one end of the routing (i.e., along one end wall of the routing); can be provided at both ends of the routing (i.e., along both end walls of the routing as shown in FIG. 17); the open gap or space can be provided at both ends of the routing and between the webs; or the open gap or space can be provided only between the webs (FIGS. 18A-C).

FIGS. 18A-C show the principles of a joist with X-shape webs. FIG. 18A discloses the web pattern 45 at one side of the chords 41 and 42 including end vertical 43 (that extends vertically between the chords 41, 42) and webs 44, A transition 48 in the middle of the joist is indicated where one web pattern starting at one joist end joins with the other web pattern starting in the other joist end. FIG. 18B shows webs on the other side of the same chords 41, 42. In other words, FIG. 18B shows a web pattern that is a reverse image of the one shown in FIG. 18A. FIG. 18C discloses the joist with both web patterns (i.e., the two web patterns of FIGS. 18A and 18B are combined into a single integrated web pattern). As mentioned, in the middle of the joist there is a transition area 48 where one web patterns join starting at joist ends.

In accordance with the present disclosure one or more of the following numbered features are present and/or the following functions are performed:

1. The chord routing goes through the lower chord or by analogy goes through the upper chord when the fingers in the upper ends of the webs are fixed in the upper chord routing and the finger of one web extends at least in the inner edge through the chord or the chord routing is open through the chord at least in one end:
   - to obtain a large glue area and high strength for the joint or
   - to relieve the chord routing or
   - to ease the quality checking of the joint or
   - to obtain an effective upper chord support in the joist or
   - to avoid water pockets or
   - to obtain a joint with no or negligible joint eccentricity or
   - to allow flexible web setting in the joist or
   - to dampen the stress peaks in the finger joint or
   - to obtain a joint without any open routings or
   - to obtain a joint without any void in the joint or
   - to obtain a reliable joint which does not need a proof-loading or
   - to obtain a structural connection between the joist and cast slab, e.g. concrete slab, above the joist or
   - to obtain a joist which has a ductile failure or
   - to obtain a good-looking glued trussed joist.
2. Two webs wherein each web has one straight end cut in its lower end which makes a sharp angle, <90 degrees, regarding the lower chord direction creating a peak and the webs overlap in the peak portions and one half of the peak portion is absent in each web and the plane between the peak halves is parallel with the lower chord.
3. A plane between the peak halves makes an angle regarding the direction of the lower chord to obtain a tapering finger in the chord direction i.e. the fingertip thickness in the peak is less than half routing breadth in the peak location.
4. The webs have only one finger in the lower ends.
5. A joint with two webs, one in tension and the other in compression wherein the left web has one straight end cut in its lower end which makes a sharp angle, <90 degrees, with the lower chord direction creating a peak and the lower end of the right web has at least one end cut which is parallel with the direction of the left web and the thickness of the right web is higher than the thickness of the left web and the glue area between the left web and the lower chord is higher in the left web than the corresponding glue area in the right web and the left web is in tension and the right web in compression or the lower end of the right has one end cut which makes a sharp angle with the lower chord and the peak portions of the webs overlap.
6. A joint with one web which is the first web of the joist in its either end fixed to the upper chord, wherein the joist is supported at the upper chord overhanging the said joint.
7. A joint with an open chord routing at either routing end wherein the routing is open through the chord to avoid water pockets i.e. the water may run through the chord.
8. A joint wherein the routing end matches the outer edges of the webs, e.g. obtained using a saw blade as the processing tool and guiding it along the web edges.
9. A joint wherein the routing ends match the web edges in the faces of the chords, normally the glue applied in all sides of at least one finger e.g. obtained using a saw blade as the rotating tool, and by selecting an appropriate blade diameter and moving the tool perpendicular to the chord only.
10. A joist wherein it includes at least one joint having one or more of the above features.
11. A joist wherein the joints are made closed, i.e. the joist is good-looking.
12. A joist wherein the joist is a trussed joist in its full length and has two web types, a dull web and a sharp web, both have symmetric end cutting regarding each other, the sharp web has one end cut which makes a sharp angle regarding the chords and the dull web has one or two end cuts, one end cut is parallel with the direction of the adjacent sharp web, if the joist has an upper chord support the first web of the joist is sharp and second one is dull and vice versa if the joist has a lower chord support and these two webs are fixed in contact with each other, and the webs in the inner third of the joist are sharp and fixed apart from each other.
13. A joist used for a long span or for a heavy load which include two web types wherein in the outermost thirds of the joist, all compressed webs are dull and all tension webs are sharp.

14. A method for processing the chord routing for a joint described above wherein the routing is processed using a rotating tool or a chain saw dimensions of which are selected to make the routing by not moving the tool in the chord direction.
15. A method for processing the chord routing for a joint wherein the routing path is fixed such that the ring of the tool follows the outer edges of the webs to obtain predefined gap at the routing ends or to obtain a joint with no gap.
16. A method for processing the chord routing for a joint wherein the routing apparatus processes simultaneously routings for several fingers or even several chords.
17. A method for processing a chord routing of a joint wherein the routing is applied from the outer side of the chord.
18. A method for quality assurance of a joint wherein the existence of the glue in the joint is checked via the routing at the outer face of the chord or a test sample is bored through the fingers and the appropriateness of the joint is defined by inspecting the sample.

What is claimed is:

1. A joint in a glued trussed joist comprising:

a first chord that has an inner face and an opposite outer face;

a second chord that has an inner face that faces the inner face of the first chord and an opposite outer face that faces away from the first chord, the first and second chords being spaced apart;

a first elongated web having an upper end and an opposite lower end; and a second elongated web having an upper end and an opposite lower end;

wherein the upper end of the first elongated web and the upper end of the second elongated web are connected to the first chord and the lower end of the first elongated web and the lower end of the second elongated web are connected to the second chord such that the first and second elongated webs define a crosswise opening;

wherein the lower end of each of the first elongated web and the second elongated web has at least one straight or tapering tenon finger; wherein the second chord has a mortise routing formed therein that is complementary to and receives the tenon fingers of the first and second elongated webs to create the joint in the second chord using glue, the first elongated web being in tension and being fixed in the mortise routing with a fingertip of the first elongated web, that is formed at the lower end of the first elongated web, the first elongated web having an inner edge that is located closer to the second elongated web compared to an outer edge that is opposite to the inner edge, the finger tip of the said inner edge being visible at the outer face of the second chord.

2. The joint of claim 1, wherein a crossing point of an edge of the first elongated web that is closer to the second elongated web and an edge of the second elongated web that is closer to the first web is at or below the upper face of the second chord.

3. The joint of claim 1, wherein the first elongated web is free of shoulders along a length thereof or contains shoulders that are less than 5% of a thickness of the first elongated web along a length thereof.

4. The joint of claim 1, wherein the fingertip of the inner edge of the first elongated web lies within 0-3 mm of the outer face of the second chord.

5. The joint of claim 1, wherein an outer edge of the first elongated web with tension contacts a first end wall of the mortise routing at first and second points so as to define a first closed space between the first elongated web and the first end wall, wherein the outer edge of the first elongated web contacts the first end wall of the mortise routing at the inner face of the second chord at the first point and contacts the first end wall of the mortise routing at the outer face of the second chord at the second point and wherein there is a gap between said contact points between the outer edge of the first elongated web and the first end wall of the mortise routing.

6. The joint of claim 1, wherein a shape of an outer edge of the first elongated web matches a first end wall of the mortise routing such that the outer edge of the first elongated web seats against the first end wall at the inner face or at the outer face of the second chord only.

7. The joint according to claim 1, wherein a routing opening formed in the second chord is larger in the outer face than in the inner face.

8. The joint according to claim 1, wherein one of the first elongated web and the second elongated web is in tension and the other of the first elongated web and the second elongated web is in compression, wherein the elongated web in tension has a web thickness that is smaller than a web thickness of the elongated web in compression and the elongated web in compression has shoulders in the root of the tenon fingers.

9. The joint according to claim 1, wherein one of the first elongated web and the second elongated web is in tension and the other of the first elongated web and the second elongated web is in compression, wherein the elongated web in tension has a glue area that is greater in area than a glue area of the elongated web in compression and the elongated web in compression has a greater thickness compared to a thickness of the elongated web in tension.

10. A joint in a glued trussed joist comprising:

a first chord that has an inner face and an opposite outer face;

a second chord that has an inner face that faces the inner face of the first chord and an opposite outer face, the first and second chords being spaced apart;

a first elongated web having an upper end and an opposite lower end; and a second elongated web having an upper end and an opposite lower end;

wherein the upper end of the first elongated web and the upper end of the second elongated web are connected to the first chord and the lower end of the first elongated web and the lower end of the second elongated web are connected to the second chord such that the first and second elongated webs define a crosswise opening having one of about a triangular shape and a trapezoidal shape;

wherein the lower end of each of the first elongated web and the second elongated web has at least one straight or tapering tenon finger; wherein the second chord has a mortise routing formed therein that is complementary to and receives the tenon fingers of the first and second elongated webs to create the joint in the second chord using glue, the mortise routing of the second chord extending through the second chord so as to be open along both the inner face and the outer face and being defined by first and second routing ends, an open gap is formed between at least one of the first and second routing ends of the mortise routing and the at least one straight or tapering tenon finger of one of the first elongated web and the second elongated web, thereby defining a continuous fluid pathway at at least one of: (1) one of a first routing end wall and a second routing end wall and (2) between the first and second elongated webs within the mortise routing from the opening of the mortise routing at the inner face to the opening of the mortise routing at the outer face.

11. The joint of claim 10, wherein an end edge of the at least one straight or tapering tenon finger that defines the lower end of one of the first elongated web and the second elongated web lies, at least at a web edge which is closer the other web, within about −3 mm to +3 mm of a plane that contains the outer face of the second chord.

12. A method for performing quality assurance of an integrity of a joint of a trussed joist that includes a chord with an inner face and opposite outer face and at least one straight or tapering mortise finger in the chord and at least one web having a tenon finger matching with a mortise routing formed through the chord, wherein the at least one web is inserted from an inner side of the chord in the mortise routing and glue is used to make the joint resistive to stresses in the joist, the method comprising the step of:

visually checking for an existence of the glue in the tenon finger by inspecting tips or the sides of the tenon finger from an outer face of the mortise routing that is open along the outer face of the chord or from one or more gaps that are defined between the at least one web and one respective routing end.

13. The method according to claim 12, wherein a round test sample diameter less than about one half chord depth is bored horizontally or diagonally through at least one web-chord glue area and the validity of the joint is resolved by inspecting the test sample.

14. The joint of claim 1, wherein routing end walls at the inner face of the second chord and routing end walls at the outer face of the second chord lie along a common circle or there is a gap between the routing end walls and the adjacent first and second elongated webs and a size of the routing is large enough to include the common circle with a diameter of at least about 120 mm simultaneously touching the routing end walls at the outer face of the second cord.

15. A joint in a glued trussed joist comprising:

a first chord that has an inner face and an opposite outer face, the first chord having a first mortise routing formed therein;

a second chord that has an inner face that faces the inner face of the first chord and an opposite outer face that faces away from the first chord, the first and second chords being spaced apart, the second chord having a second mortise routing formed therein;

an elongated web having an upper end and an opposite lower end; and a support coupled to the first chord;

wherein the upper end of the elongated web has at least one straight or tapering tenon finger fixed in the matching first mortise routing of the first chord using glue and a lower end of the elongated web has at least one straight or tapering tenon finger fixed in the matching second mortise routing of the second chord using glue;

wherein the elongated web and the support act on the first chord create a truss joint in the first chord;

wherein the finger of the upper end of the elongated web is visible in full depth at the outer face of the first chord and wherein the finger of the upper end of the elongated web at a side of the support lies within 0-3 mm of the upper face of the first chord;

wherein the first mortise routing is defined by routing end walls located at the inner face of the first chord and at the outer face of the first chord, the routing end walls of the first mortise routing lying along a common circle and there is a gap between the routing end wall which is further away from the support or there is no gap between the routing end wall which is further away from the support and the elongated web and the first mortise routing is large enough to include a common circle with a diameter of at least about 120 mm simultaneously touching the routing end walls at the outer face of the first cord.

16. The joint of claim 15, wherein the elongated web comprises a first elongated web and the joint further includes:

a second elongated web having an upper end and an opposite lower end;

wherein the upper end of the second elongated web is connected to the first chord at a location spaced from the upper end of the first elongated web and the lower end of the first elongated web and the lower end of the second elongated web are connected to the second chord such that the first and second elongated webs define a crosswise opening; and wherein the lower end of the second elongated web has at least one straight or tapering tenon finger; wherein the second mortise routing formed in the second chord is complementary to and receives the tenon fingers of the two elongated webs to create the joint in the second chord using glue, the first elongated web being in tension and being fixed in the second mortise routing with the finger of the elongated web, that is formed at the lower end of the elongated web, being visible, at least in an edge of the elongated web which is further away from the support, within the second mortise routing at the outer face of the second chord.

17. The joint of claim 15, wherein the first mortise routing in the first chord has an open gap through the first chord at least at either side of the elongated web and one routing end wall of the first mortise routing.

* * * * *